US009680216B2

(12) United States Patent
Hsu et al.

(10) Patent No.: US 9,680,216 B2
(45) Date of Patent: Jun. 13, 2017

(54) COMMUNICATION DEVICE WITH A GROUND ELEMENT DIRECTLY CONNECTED TO AN INVERTED T-SHAPED GROUND PLANE

(71) Applicant: Quanta Computer Inc., Taoyuan (TW)

(72) Inventors: Hung-Ren Hsu, Taoyuan (TW); Chun-I Lin, Taoyuan (TW); Huei Lin, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 86 days.

(21) Appl. No.: 14/818,575

(22) Filed: Aug. 5, 2015

(65) Prior Publication Data

US 2017/0012352 A1 Jan. 12, 2017

(30) Foreign Application Priority Data

Jul. 9, 2015 (TW) ..... 104122256 A

(51) Int. Cl.

| | |
|---|---|
| ***H01Q 1/38*** | (2006.01) |
| ***H01Q 1/48*** | (2006.01) |
| ***H01Q 5/378*** | (2015.01) |
| *H01Q 9/04* | (2006.01) |

(52) U.S. Cl.

CPC ..... *H01Q 1/48* (2013.01); *H01Q 5/378* (2015.01); *H01Q 9/0421* (2013.01)

(58) Field of Classification Search

CPC ..... H01Q 1/241; H01Q 1/243; H01Q 1/48; H01Q 1/24; H01Q 5/378; H01Q 9/0421; H01Q 1/38

USPC ..... 343/702, 700 MS, 846, 848

See application file for complete search history.

(56) References Cited

U.S. PATENT DOCUMENTS

| | | | | |
|---|---|---|---|---|
| 6,421,016 | B1 * | 7/2002 | Phillips | H01Q 1/245 343/702 |
| 7,612,722 | B2 * | 11/2009 | Haho | H01Q 1/243 343/702 |
| 7,843,389 | B2 * | 11/2010 | Luk | H01Q 9/0421 343/700 MS |
| 8,085,202 | B2 * | 12/2011 | Ayatollahi | H01Q 1/243 343/700 MS |
| 8,860,623 | B2 * | 10/2014 | Lo | H01Q 1/521 343/702 |
| 2006/0290574 | A1 * | 12/2006 | Tsai | H01Q 1/243 343/700 MS |
| 2009/0273535 | A1 * | 11/2009 | Lee | H01Q 1/243 343/848 |

* cited by examiner

*Primary Examiner* — Tho G Phan
(74) *Attorney, Agent, or Firm* — McClure, Qualey & Rodack, LLP

(57) ABSTRACT

A communication device includes a system ground plane, a ground element, an antenna element, and a metal guide line. The ground element is coupled to the system ground plane. The ground element has a first edge, a second edge, and a connection point. The first edge and the second edge are opposite to each other. The connection point is positioned at the second edge. The antenna element is disposed adjacent to, or at, the first edge. One end of the metal guide line is coupled to the connection point, and another end of the metal guide line is open.

10 Claims, 6 Drawing Sheets

COMMUNICATION DEVICE WITH A GROUND ELEMENT DIRECTLY CONNECTED TO AN INVERTED T-SHAPED GROUND PLANE

CROSS REFERENCE TO RELATED APPLICATIONS

This Application claims priority of Taiwan Patent Application No. 104122256 filed on Jul. 9, 2015, the entirety of which is incorporated by reference herein.

BACKGROUND OF THE INVENTION

Field of the Invention

The disclosure generally relates to a communication device, and more specifically, to a communication device with an isotropic radiation pattern.

Description of the Related Art

With the progress of mobile communication technology, there are more and diverse applications for wireless communication products. Wireless access points play an important role due to the development of smart houses and the Internet of things. In order to meet market trends and consumer demand, the design of a wireless access point needs a lightweight and stylish appearance. In such a situation, embedded antennas are the first choice. Nevertheless, since embedded antennas are often disposed at a corner or at fragmented regions of a wireless access point due to its appearance or mechanism, the radiation pattern of the corresponding antenna tends to generate irregular concaves (i.e., radiation nulls), thereby affecting the whole communication quality of the devices. As a result, it has become a critical challenge for antenna designers to design an isotropic antenna in the limited space of a wireless access point.

BRIEF SUMMARY OF THE INVENTION

It should be noted that the invention does not design a unique antenna element in a communication device to achieve isotropic operation. Conversely, the invention designs a novel mechanism of current guidance for changing current distribution on a system ground plane, thereby achieving isotropic radiation. Therefore, the invention is suitable for application in a variety of small communication devices including different antenna configurations, such as wireless access points.

In a preferred embodiment, the invention is directed to a communication device including a system ground plane, a ground element, an antenna element, and a metal guide line. The ground element is coupled to the system ground plane. The ground element has a first edge, a second edge, and a connection point. The first edge and the second edge are opposite to each other. The connection point is positioned at the second edge. The antenna element is disposed adjacent to, or at, the first edge. One end of the metal guide line is coupled to the connection point, and another end of the metal guide line is open.

The invention proposes a novel radiation mechanism for appropriately guiding currents on the system ground plane, so as to change the total radiation pattern of the communication device. Without adjusting the antenna element, the invention adds a current guide line for affecting the current distribution on the system ground plane, such that the surface currents are uniformly distributed on the system ground plane and some current nulls are eliminated. The current guide line enhances the symmetry of the antenna element arranged in the communication device, and therefore the communication device can achieve an isotropic radiation pattern.

In some embodiments of the invention, the metal guide line is coupled to the ground element. The length of the metal guide line is at least 0.2 times the length of the ground element. The metal guide line increases the effective resonant length of the ground element, and therefore a resonant mode of the antenna element is excited well. The impedance matching of the antenna element is also improved. According to the practical measurements, the metal guide line does not reduce the operation bandwidth of the antenna element. It should also be noted that when the total length of the metal guide line and the ground element is an integer multiple of 0.25 wavelength of a central operation frequency of the antenna element, the metal guide line can attract more surface currents on the system ground plane. As a result, the distribution of surface currents becomes more uniform, thereby improving the radiation pattern of the antenna element. In other words, the metal guide line is configured to remove the radiation nulls of the antenna element, resulting in an isotropic radiation pattern of the antenna element.

In some embodiments, the metal guide line is a metal single-core wire, or the metal guide line and the ground element are both printed on a dielectric substrate. In some embodiments, the metal guide line substantially has a straight-line shape. In some embodiments, the metal guide line substantially has an inverted-L shape. In some embodiments, the metal guide line substantially has a spiral shape. In some embodiments, the antenna element is a planar antenna. In some embodiments, the communication device further includes a device housing, and the metal guide line is affixed by the device housing. In some embodiments, the ground element is formed by an extension portion of the system ground plane, and a combination of the ground element and the system ground plane substantially has an inverted T-shape.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Figure 1:
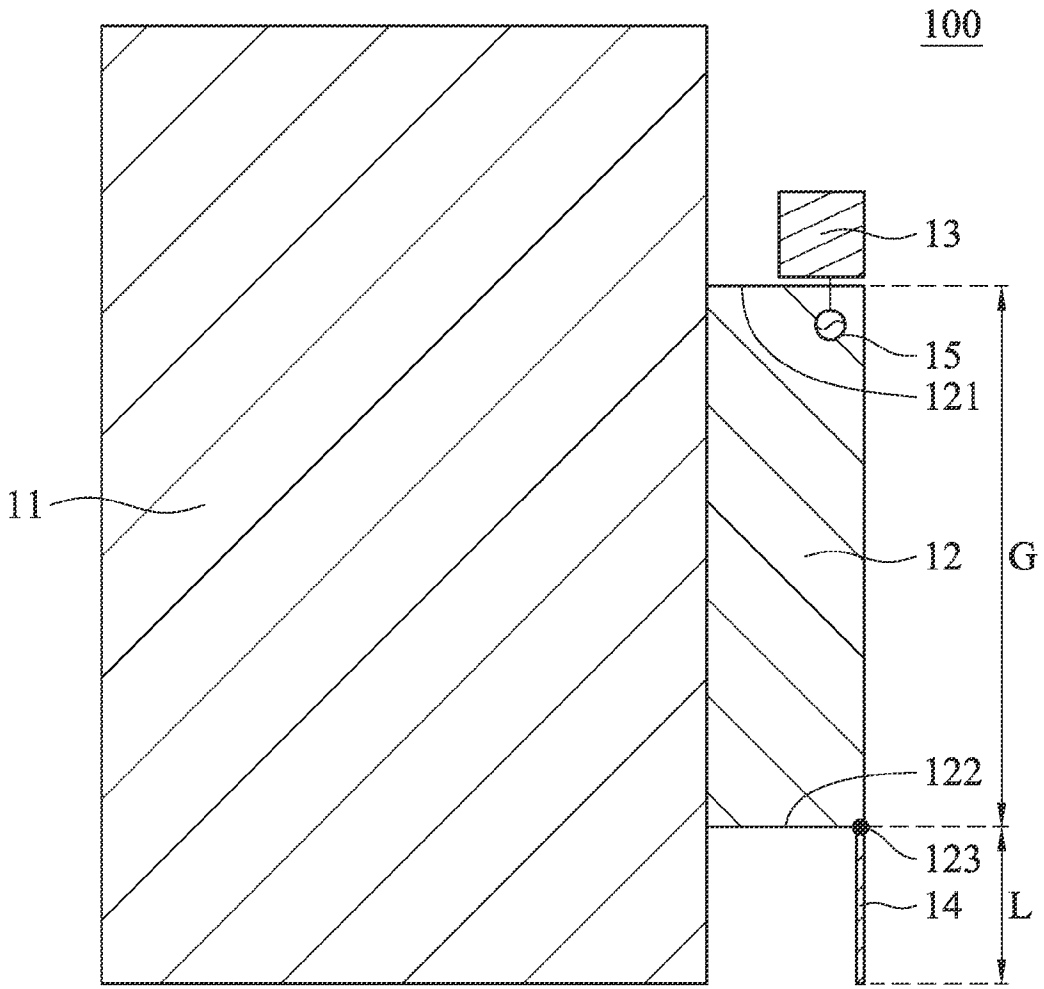
FIG. 1 is a diagram of a communication device according to a first embodiment of the invention.

FIG. 1 is a diagram of a communication device 100 according to a first embodiment of the invention. The communication device 100 may be a wireless access point. As shown in FIG. 1, the communication device 100 at least includes a system ground plane 11, a ground element 12, an antenna element 13, and a metal guide line 14. The system ground plane 11, the ground element 12, and the antenna element 13 may be made of conductive materials, such as copper, silver, aluminum, iron, or their alloys. The ground element 12 may be coupled to the system ground plane 11, or may be formed by an extension portion of the system ground plane 11. A combination of the ground element 12 and the system ground plane 11 may substantially have an inverted T-shape. The ground element 12 has a first edge 121, a second edge 122, and a connection point 123. The first edge 121 and the second edge 122 are opposite to each other. The antenna element 13 is disposed adjacent to, or at, the first edge 121 of the ground element 12. The type of the antenna element 13 is not limited in the invention. For example, the antenna element 13 may be a monopole antenna, a dipole antenna, a loop antenna, a helical antenna, or a chip antenna. The signal source 15 may be an RF (Radio Frequency) module of the communication device 100, and may be configured to excite the antenna element 13. The connection point 123 is positioned at the second edge 122 of the ground element 12. One end of the metal guide line 14 is coupled to the connection point 123 on the ground element 12, and another end of the metal guide line 14 is open. In some embodiments, the communication device 100 further includes a device housing (not shown), and the metal guide line 14 is affixed by the device housing. For example, the metal guide line 14 may be printed on an inner surface of a nonconductive housing of the communication device 100. In alternative embodiments, the metal guide line 14 is an external metal single-core wire, or the metal guide line 14 and the ground element 12 are both printed on a dielectric substrate, such as an FR4 (Flame Retardant 4) substrate. The length L of the metal guide line 14 is shorter than the length G of the ground element 12. Specifically, the length L of the metal guide line 14 is at least 0.2 times the length G of the ground element 12. The total length (L+G) of the metal guide line 14 and the ground element 12 is an integer multiple of 0.25 wavelength of a central operation frequency of the antenna element 13 (i.e., $L+G=\lambda/4\times N$, where N is a positive integer, and $\lambda$ is the wavelength of the central operation frequency of the antenna element 13). It should be noted that the communication device 100 may further includes other components, such as a touch control panel, a processor, a battery, and a nonconductive housing (not shown).

Figure 2:
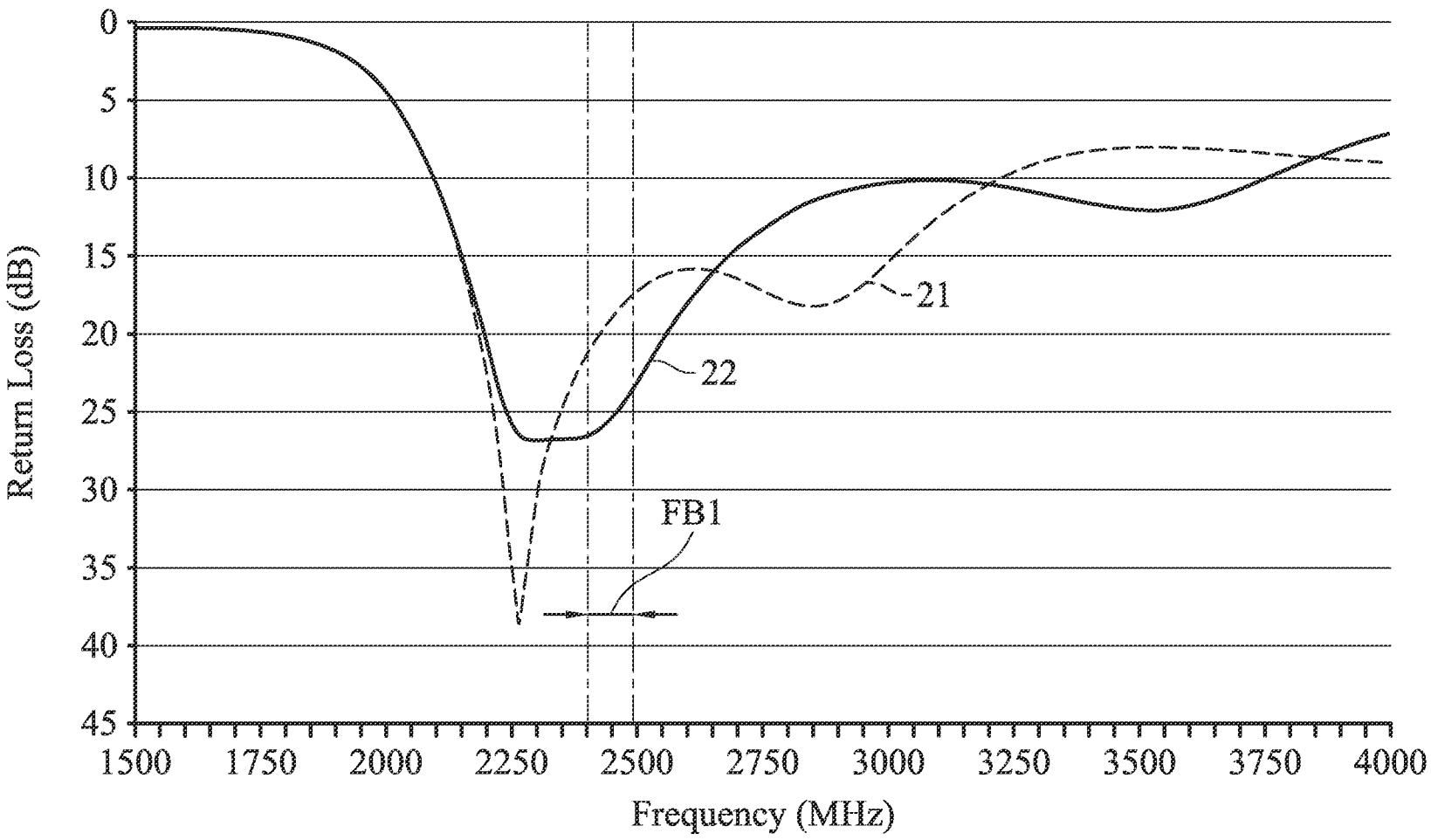
FIG. 2 is a diagram of return loss of an antenna element of a communication device according to a first embodiment of the invention.

FIG. 2 is a diagram of return loss of the antenna element 13 of the communication device 100 according to the first embodiment of the invention. In some embodiments, the element sizes and element parameters of the communication device 100 are as follows. The system ground plane 11 has a length of about 80 mm and a width of about 80 mm, and it is substantially a ground plane size of a wireless access point. The ground element 12 has a length (G) of about 62 mm and a width of about 20 mm. The antenna element 13 has a length of about 10 mm and a width of about 10 mm. For example, the antenna element 13 may be a coupled-fed PIFA (Planar Inverted F Antenna) with small size and simple structure, and it may be formed on an FR4 substrate having a thickness of about 0.4 mm. The metal guide line has a width of about 0.2 mm and a length (L) of about 18 mm. As shown in FIG. 2, a first return loss curve 21 represents the characteristic of the antenna element 13 of the communication device 100 without any metal guide line, and a second return loss curve 22 represents the characteristic of the antenna element 13 of the communication device 100 with the metal guide line 14. According to the measurement result of FIG. 2, the antenna element 13 can cover an operation frequency band FB1 of Wi-Fi 802.11 b/g/n from about 2400 MHz to about 2484 MHz. The metal guide line 14 does not negatively affect the impedance matching of the antenna element 13. In other words, even if the metal guide line 14 is included, the antenna element 13 can still cover the operation bandwidth from 2400 MHz to 2484 MHz completely.

Figure 3B:
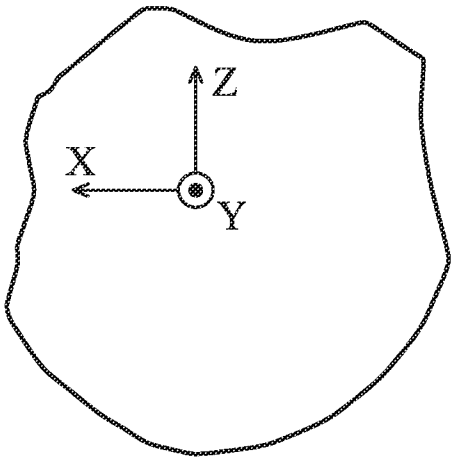
FIG. 3B is a far-field radiation pattern of an antenna element of a communication device with a metal guide line according to a first embodiment of the invention.
Figure 3A:
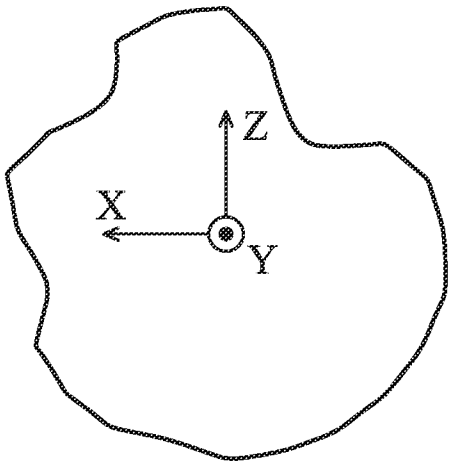
FIG. 3A is a far-field radiation pattern of an antenna element of a communication device without any metal guide line.

FIG. 3A is a far-field radiation pattern of the antenna element 13 of the communication device 100 without any metal guide line. FIG. 3B is a far-field radiation pattern of the antenna element 13 of the communication device 100 with the metal guide line 14 according to the first embodiment of the invention. The operation frequency of the aforementioned far-field patterns is the central frequency of IEEE 802.11 b/g/n bands, i.e., 2440 MHz. According to the measurement of FIG. 3A, if there is no metal guide line in the communication device 100, the radiation pattern of the antenna element 13 may have some relatively deep concaves in specific directions (i.e., radiation nulls, and their intensity is about −7 dBi), and therefore the communication device 100 (wireless access point) cannot establish stable wireless connection to other devices in these specific directions. In order to solve the problem, the invention adds the metal guide line 14 into the communication device 100. Such a design forms a metal branch on the system ground plane 11 to guide ground plane currents. As a result, the surface currents are uniformly distributed on the system ground plane 11 and the ground element 12, thereby removing current nulls of the antenna element 13 and solving the problem of the concave radiation pattern. As shown in FIG. 3B, after the metal guide line 14 is included in the communication device 100, the original radiation nulls of the antenna element 13 disappear (i.e., their intensity increases from −7 dBi to −3 dBi, and the difference therebetween is about 4 dBi), and an almost isotropic radiation pattern is obtained.

Figure 4:
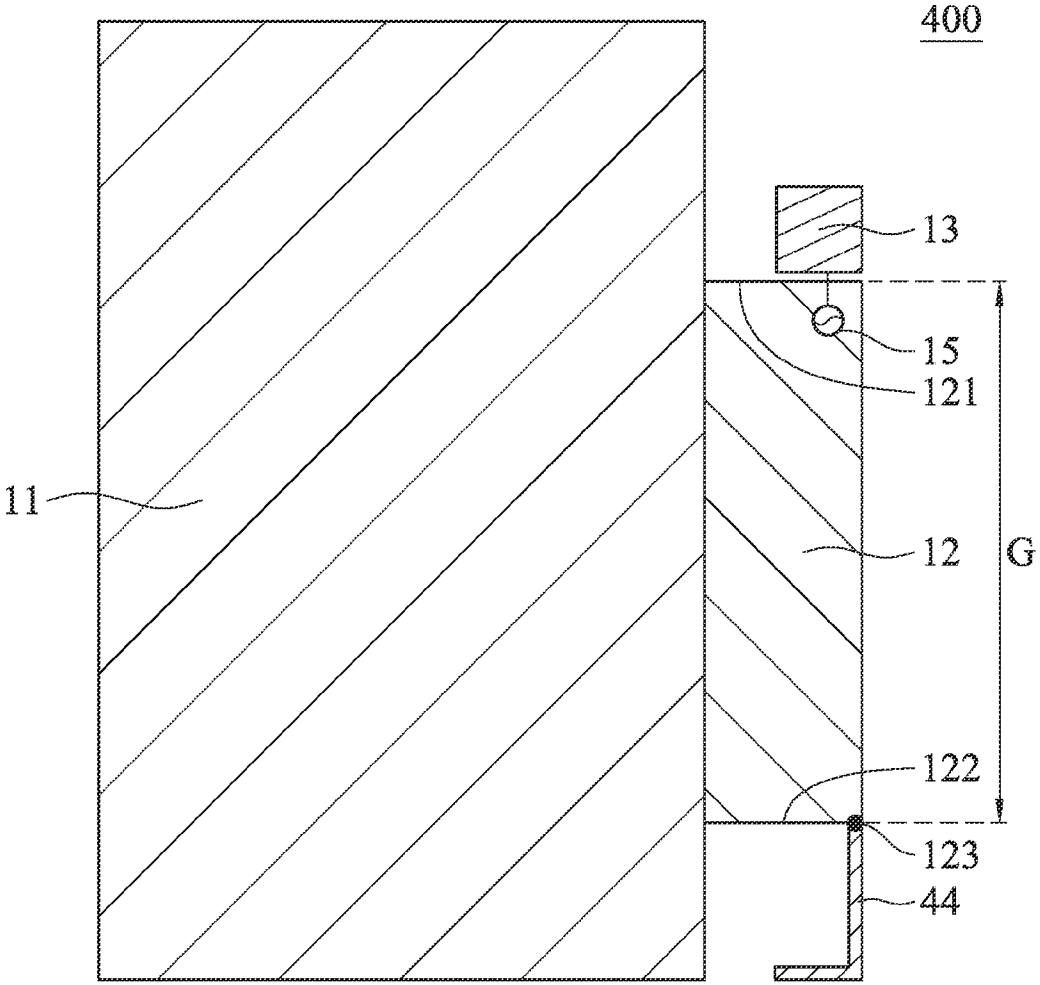
FIG. 4 is a diagram of a communication device according to a second embodiment of the invention.

FIG. 4 is a diagram of a communication device 400 according to a second embodiment of the invention. FIG. 4 is similar to FIG. 1. In the second embodiment, a metal guide line 44 of the communication device 400 substantially has an inverted L-shape. The bending metal guide line 44 can further reduce its total size. Other features of the communication device 400 of the second embodiment are similar to those of the communication device 100 of the first embodiment. Accordingly, the two embodiments can achieve similar levels of performance.

Figure 5:
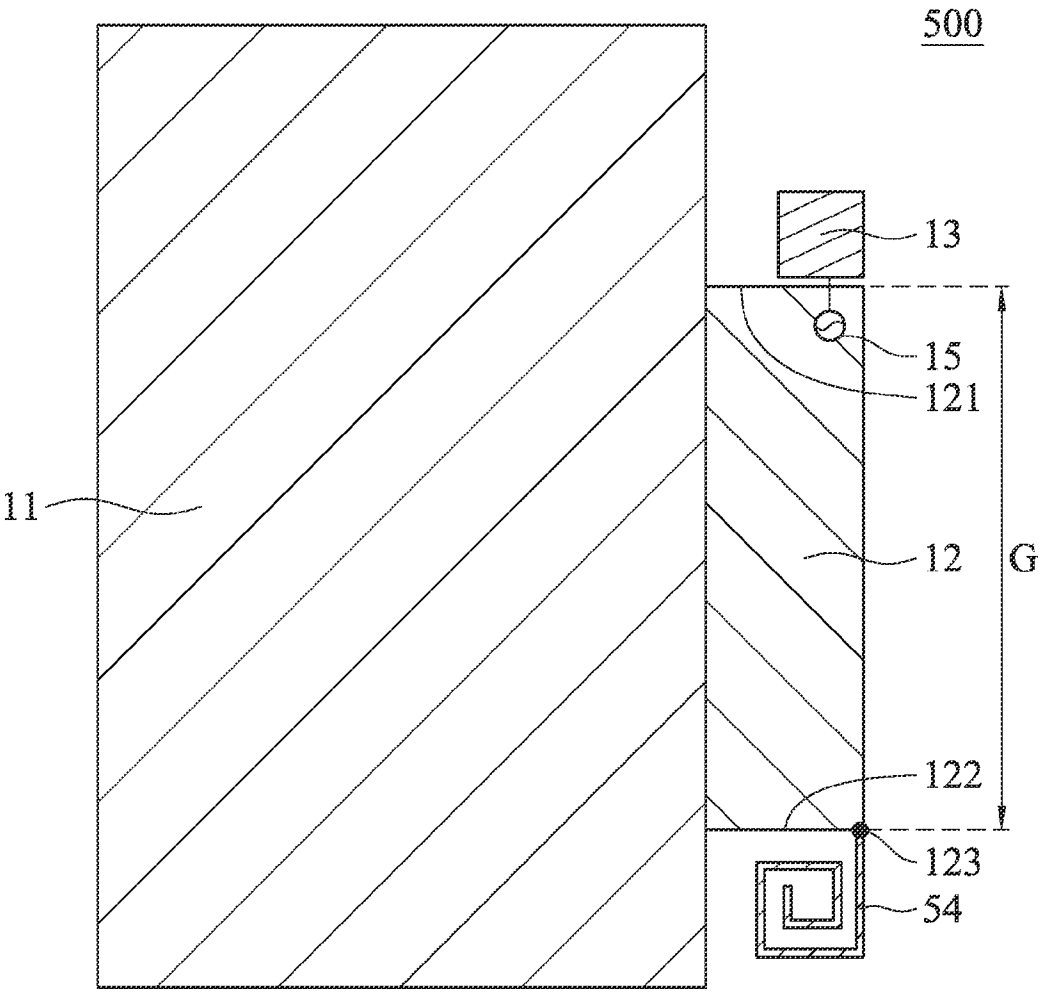
FIG. 5 is a diagram of a communication device according to a third embodiment of the invention.

FIG. 5 is a diagram of a communication device 500 according to a third embodiment of the invention. FIG. 5 is similar to FIG. 1. In the third embodiment, a metal guide line 54 of the communication device 500 substantially has a spiral shape. The bending metal guide line 54 can further reduce its total size. Other features of the communication device 500 of the third embodiment are similar to those of the communication device 100 of the first embodiment. Accordingly, the two embodiments can achieve similar levels of performance.

Figure 6:
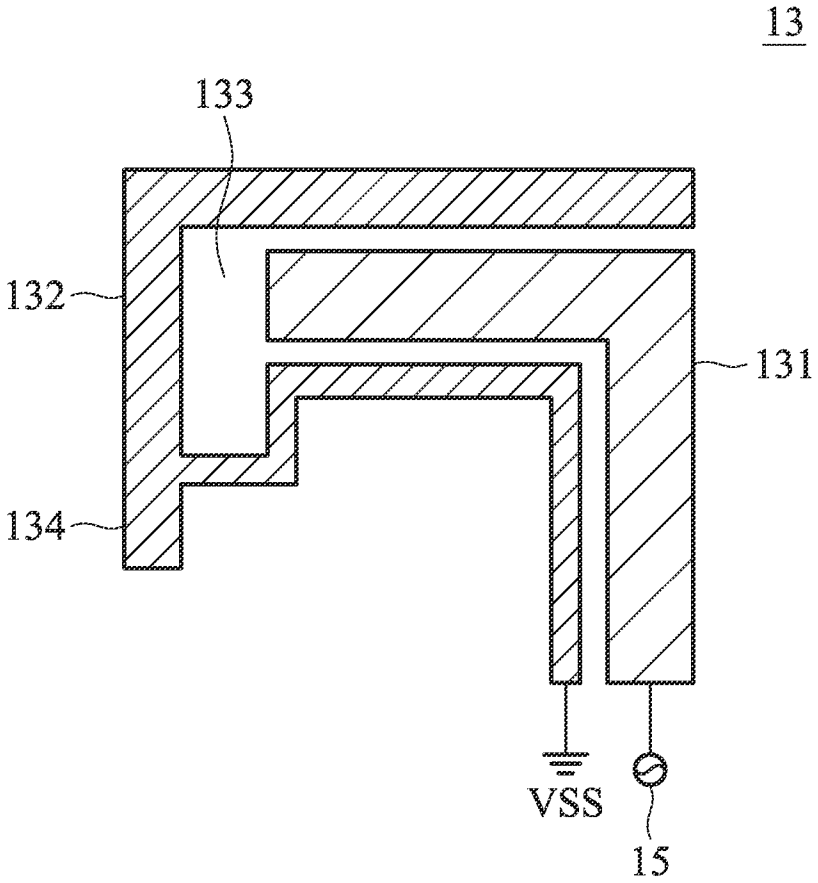
FIG. 6 is a diagram of an antenna element according to a fourth embodiment of the invention.

FIG. 6 is a diagram of the antenna element 13 according to a fourth embodiment of the invention. The antenna element 13 is a planar antenna. Specifically, the antenna element 13 is a coupled-fed loop antenna. The antenna element 13 includes a feeding radiation element 131 and a grounding radiation element 132. The feeding radiation element 131 is completely separate from the grounding radiation element 132, and a coupling gap is formed therebetween, such that feeding energy is delivered from the feeding radiation element 131 to the grounding radiation element 132. For example, the width of the coupling gap is shorter than 2 mm. The feeding radiation element 131 substantially has an inverted L-shape. One end of the feeding radiation element 131 is coupled to the signal source 15, and another end of the feeding radiation element 131 is open. The grounding radiation element 132 substantially has an inverted Y-shape. One end of the grounding radiation element 132 is coupled to a ground voltage VSS. The ground voltage VSS may be provided by the ground element 12. The grounding radiation element 132 defines an inverted-L-shaped notch 133. The open end of the feeding radiation element 131 extends into the inverted-L-shaped notch 133. The grounding radiation element 132 further includes an additional branch 134. The additional branch 134 substantially has a straight-line shape, and extends toward the ground element 12. The antenna element 13 of FIG. 6 may be applied to any embodiment of the aforementioned communication devices 100, 400, and 500.

Note that the element sizes, element shapes, and frequency ranges described above are not limitations of the invention. An antenna designer can adjust these settings or values according to different requirements. It should be understood that the communication device and the antenna element of the invention are not limited to the configurations of FIGS. 1-6. The invention may merely include any one or more features of any one or more embodiments of FIGS. 1-6. In other words, not all of the features shown in the figures should be implemented in the communication device and the antenna element of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a system ground plane;

a ground element, coupled to the system ground plane, wherein the ground element has a first edge, a second edge, and a connection point, the first edge and the second edge are opposite to each other, and the connection point is positioned at the second edge;

an antenna element, disposed adjacent to, or at, the first edge of the ground element; and a metal guide line, wherein one end of the metal guide line is coupled to the connection point, and another end of the metal guide line is open;

wherein the ground element is directly connected to the system ground plane, and a combination of the ground element and the system ground plane substantially has an inverted T-shape.

2. The communication device as claimed in claim 1, wherein a length of the metal guide line is at least 0.2 times a length of the ground element.

3. The communication device as claimed in claim 1, wherein a total length of the metal guide line and the ground element is an integer multiple of 0.25 wavelength of a central operation frequency of the antenna element.

4. The communication device as claimed in claim 1, wherein the metal guide line is a metal single-core wire, or the metal guide line and the ground element are both printed on a dielectric substrate.

5. The communication device as claimed in claim 1, wherein the metal guide line substantially has a straight-line shape.

6. The communication device as claimed in claim 1, wherein the metal guide line substantially has an inverted-L shape.

7. The communication device as claimed in claim 1, wherein the metal guide line substantially has a spiral shape.

8. The communication device as claimed in claim 1, wherein the antenna element is a planar antenna.

9. The communication device as claimed in claim 1, wherein the communication device further comprises a device housing, and the metal guide line is affixed by the device housing.

10. The communication device as claimed in claim 1, wherein the ground element is formed by an extension portion of the system ground plane.

* * * * *